US005108463A

United States Patent [19]

Buchanan

[11] Patent Number: 5,108,463

[45] Date of Patent: Apr. 28, 1992

[54] CONDUCTIVE COATED ABRASIVES

[75] Inventor: Scott J. Buchanan, St. Paul, Minn.

[73] Assignee: Minnesota Mining and Manufacturing Company, St. Paul, Minn.

[21] Appl. No.: 551,091

[22] Filed: Jul. 16, 1990

Related U.S. Application Data

[63] Continuation-in-part of Ser. No. 495,458, Mar. 16, 1990, abandoned, which is a continuation-in-part of Ser. No. 396,513, Aug. 21, 1989, abandoned.

[51] Int. Cl.[5] ..... B24B 1/00

[52] U.S. Cl. ..... 51/295; 51/293; 51/298; 51/307

[58] Field of Search ..... 51/293, 295, 298, 307

[56] References Cited

U.S. PATENT DOCUMENTS

| | | | |
|---|---|---|---|
| 2,440,300 | 4/1948 | Rushmer et al. | 51/298 |
| 2,509,652 | 5/1950 | Rushmer et al. | 18/47.5 |
| 3,163,968 | 1/1973 | Nafus | 51/394 |
| 3,942,959 | 3/1976 | Markoo et al. | 51/295 |
| 3,992,178 | 11/1976 | Markoo et al. | 51/295 |
| 4,242,106 | 12/1980 | Morelock | 51/307 |
| 4,298,356 | 11/1981 | Teschner et al. | 51/297 |
| 4,457,766 | 7/1984 | Caul | 51/298 |
| 4,547,204 | 10/1985 | Caul | 51/298 |
| 4,588,419 | 5/1986 | Caul et al. | 51/295 |
| 4,751,138 | 6/1988 | Tumey et al. | 428/323 |
| 4,832,707 | 5/1988 | Kamohara et al. | 51/307 |

FOREIGN PATENT DOCUMENTS

| | | |
|---|---|---|
| 54-152197 | 11/1979 | Japan . |
| 58-171264 | 10/1983 | Japan . |
| 61152373 | 12/1984 | Japan . |
| 885192 | 12/1961 | United Kingdom . |
| 2018811 | 10/1979 | United Kingdom . |

OTHER PUBLICATIONS

U.S. application Ser. No. 07/352,734 (Harmer et al.) filed May 15, 1989, "Abrasive Article With Conductive, Doped, Conjugated, Polymer, Supersize Coat and Method of making Same".

*Primary Examiner*—William R. Dixon, Jr.
*Assistant Examiner*—Willie J. Thompson
*Attorney, Agent, or Firm*—Gary L. Griswold; Walter N. Kirn; Richard Francis

[57] ABSTRACT

A coated abrasive article having carbon black aggregates incorporated into the construction thereof, in a concentration sufficient to reduce or eliminate the buildup of static electricity during its use.

25 Claims, No Drawings

CONDUCTIVE COATED ABRASIVES

This is a continuation-in-part of application Ser. No. 07/495,458 filed Mar. 16, 1990, now abandoned, which is a continuation-in-part of application Ser. No. 07/396,513 filed Aug. 21, 1989, abandoned.

TECHNICAL FIELD

This invention relates to electrically conductive coated abrasive articles useful in wood finishing operations

BACKGROUND OF THE INVENTION

Coated abrasive articles, considered the premier tools for abrading and finishing plastics, wood and wood-like materials, unfortunately often suffer from the generation of static electricity during their use. The static electricity is generated by the constant interaction of the coated abrasive belt or disc with the workpiece and the back support for the belt or disc. This static charge is typically on the order of 50 to 100 kilovolts.

Static electricity is responsible for numerous problems. A sudden discharge of the accumulated static charge can cause serious injury to an operator in the form of an electrical shock or it can cause the ignition of dust particles, which poses a serious threat of fire or explosion. The static charge also causes the sawdust to cling to various surfaces, including that of the coated abrasive and electrically the non-conductive wood workpiece, thereby making it difficult to remove by use of a conventional exhaust system. Associated with this accumulation of sawdust on the coated abrasive and the wood workpiece is the further problem of "loading" of the coated abrasive (i.e., filling of the spaces between the abrasive grains with swarf). Such loading dramatically reduces the cutting ability of the abrasive grains and often results in burning the surface of the workpiece.

If the static electrical charge is reduced or eliminated, the coated abrasive article can have a significantly longer useful life, produce a finer surface finish on the workpiece and eliminate or reduce the potential for the above-mentioned hazards.

Many attempts, with varying degrees of success, have been made to solve the static electricity problem. One common approach has been to incorporate a conductive or antistatic material into the coated abrasive construction to eliminate the accumulation of electrical charge. In this regard, U.S. Pat. No. 3,163,968 (Nafus) discloses a coated abrasive article having a coating comprising graphite in a binder on the surface opposite the abrasive material. U.S. Pat. No. 3,942,959 (Markoo et al.) discloses a coated abrasive construction having a conductive resin layer sandwiched between two nonconductive resin layers to prevent the accumulation of electrostatic charge during grinding. The resin layer is made conductive by incorporating into the resin a conductive filler which may be a metal alloy, metal pigment, metal salt or metal complex. U.S. Pat. No. 3,992,178 (Markoo et al.) discloses a coated abrasive article having an outer layer comprised of graphite particles in a bonding resin which reduces the electrostatic charges generated during grinding. Japanese Unexamined Patent Publication No. 58-171264, published Oct. 7, 1983, discloses a coated abrasive article having an abrasive layer made conductive by including therein, carbon black particles having an average particle size of from 20 to 50 nanometers.

Additionally, Minnesota Mining & Manufacturing Company, the assignee of the present application, has since approximately 1975 marketed coated abrasive products under the trade designations Tri-M-ite Resin Bond Cloth Type TL and Three-M-ite Resin Bond Cloth Type TW, which contain 2% by weight carbon black and 5% by weight graphite in the adhesive size coat. The addition of the combination of carbon black and graphite to the size coat having been discovered to provide some reduction in the generation of static electricity. However, the reduction in the generation of static electricity was insufficient to prevent the sawdust from clinging to the coated abrasive article or to eliminate the risk of electrical shock. Thus there is still considerable room for improvement in reducing the generation of static electricity.

SUMMARY OF THE INVENTION

The present invention provides a coated abrasive article formed of: (a) a support member (e.g., a "backing") having a front surface and a back surface, (b) abrasive granules, (c) a first layer of binder adhesive coated on the front surface of the support member and having abrasive granules at least partially embedded therein, and (d) at least one additional layer of binder adhesive overlying the first layer of binder adhesive. The support member may also contain at least one other binder adhesive. This binder adhesive may be coated on the back surface of the support member, on the front surface of the support member or the support member may be saturated with the binder adhesive before application of the first binder layer. This invention pertains to a coated abrasive article in which at least one of these binder adhesives contains a quantity of carbon black aggregates sufficient to provide the cured binder adhesive containing the carbon black aggregates with a surface resistivity of less than 2000 kilo-ohms/cm.

The term "conductive" as used herein means electrically conductive.

It is preferable that the carbon black aggregates be predispersed in water with an appropriate dispersion aid prior to being added to the binder adhesive coating composition.

The inclusion of the conductive carbon black aggregates in the article's construction greatly reduces the build-up of static charge during the article's use, thereby eliminating electric shocks to the operator and reducing the accumulation of dust on the workpiece and sanding machine.

DETAILED DESCRIPTION OF THE INVENTION

Except for the coating containing the conductive carbon black, the coated abrasive articles of the invention are constructed from conventional materials by a method which is well known in the art. The support member is typically coated with a first layer of binder adhesive, often referred to as a "make coat", and then abrasive grains are applied. The abrasive grains may be oriented or may be applied to the support member without orientation, depending upon the requirements of the particular coated abrasive product. However, for use in wood finishing operations it is preferred that the abrasive grains be electrostatically applied so that a greater proportion of the grains have their longer axis more nearly perpendicular to the plane of the support member. Alternatively, the first layer can be a slurry coat which comprises abrasive grains distributed throughout the adhesive binder. Thereafter, the resulting adhesive/abrasive composite layer is then generally solidified or set sufficiently to retain the abrasive grains on the support member so that a second layer of binder adhesive, often referred to as a "size coat", can be applied. The size coat further reinforces the coated abrasive product. Optionally, an additional binder adhesive overcoat, often referred to as a "supersize coat", which may contain grinding aids or other well known additives, can be applied over the size coat. Once the final adhesive coating is solidified, the resulting coated abrasive product can be converted into a variety of conventional forms such as, for example, sheets, rolls, belts and discs.

The conventional components forming the coated abrasive product of the invention may be selected from those typically used in this art. For example, the support member may be formed of paper, cloth, vulcanized fiber, polymeric film or any other suitable material currently known or which becomes available for this use in the future. The abrasive granules may be of any size and type conventionally utilized in the formation of coated abrasives such as, for example, flint, garnet, aluminum oxide, ceramic aluminum oxide, alumina zirconia, diamond, silicon carbide or mixtures thereof. Preferably, the abrasive granules are selected from the group consisting of garnet, aluminum oxide, ceramic aluminum oxide, alumina zirconia and silicon carbide, and have a size ranging from about 16 grade (average particle diameter of about 1320 ) to about 1200 grade (average particle diameter of about 6.5). The bond system, which secures the abrasive granules to the support member, may be formed from urethane resins, phenolic reins, epoxy resins, acrylate resins, urea-formaldehyde resins, melamine-formaldehyde resins, glues or mixtures thereof. The bond system may also include other additives well known in the art such as fillers, grinding aids, coupling agents, dyes, wetting agents and surfactants.

If the coated abrasive support member is cloth, is preferably has one or more binder adhesive layers which serve to seal the cloth and modify the final properties of the cloth. In general if the binder adhesive is present on the front surface of the support member beneath the abrasive coating, it is referred to as a "presize". If it is present on the back surface of the support member on the opposite surface as the presize, it is referred to as a "backsize". If the binder adhesive saturates the support member, it is referred to as a "saturant".

The coated abrasive product of the invention may also include such other modifications as are conventional in this art. For example, a coating of a pressure-sensitive adhesive may be applied to the nonabrasive side of the construction.

At least one cured binder adhesive of the coated abrasive article of the invention is made conductive by incorporating carbon black aggregates into the formulation of at least one of the following: make coat, slurry coat, size coat, supersize coat, backsize coat, presize coat, and saturant.

The carbon black useful in the present invention is an amorphous modification of carbon, typically formed by the partial combustion of hydrocarbons, which has an outermost oxidized atomic layer due to exposure to air. The carbon black aggregates can be added directly to the coating formulations. Alternatively, the carbon black aggregates can be added to the coating formulations in the form of an aqueous dispersion. This latter method is preferred as the dispersion of the carbon black aggregates throughout the coating formulations is more easily accomplished if the carbon black aggregates are predispersed in an aqueous solution. Generally, if a predispersed form is utilized, a greater percentage of carbon black aggregates may be present in the adhesive binder while maintaining the proper viscosity for coating. If the aggregates are not predispersed, the viscosity is higher, which may lead to difficulty in processing. Furthermore, aqueous dispersions of carbon black aggregates are commercially available from sources such as CDI Dispersions of Newark, N.J.

Preferably carbon black aggregates, a dispersion aid, and a liquid dispersing medium such as water are mixed together until a homogeneous coating composition is achieved. More than one compatible dispersion aid may be used. This dispersion is then added to the adhesive binder. If the liquid dispersing medium is water, the dispersion aid can be an anionic or ionic surfactant. Typical examples of surfactant dispersion aids include commercially available surfactants such as "DAXAD 11G" from W. R. Grace of Lexington, Mass.; "LOMAR PWA" and "NOPCOSPERSE A-23" from Henkel Corporation of Ambler, Pa. and "MARASPERSE CBOS-4" from Daishowa Chemicals Inc. of Rothschild, Wis. The weight ratio of carbon black aggregates to dispersion aid preferably is in the range of 2:1 to 30:1 and more preferably in the range of 4:1 and 12:1. If this ratio is too low or too high, the resulting viscosity may be too high. If the amount of dispersion aid is too great, unwanted recoagulation of the carbon black aggregates may occur. Preferably, the dispersion contains 1 to 25 weight percent carbon black aggregates.

The carbon black aggregate dispersion may be in an organic liquid instead of water. A dispersion aid which will be compatible with the particular organic liquid should then be employed. More than one compatible organic liquid may be used. It is preferred to use water as the dispersing medium to avoid the environmental concerns associated with organic liquids.

As will be recognized by those skilled in the art, it is important to match the proper dispersion aid with the adhesive binder. If the dispersion aid and the adhesive binder are not compatible, the resulting coating composition may be too viscous. For example, an anionic dispersion aid is preferred with phenolic adhesive systems. One skilled in the adhesive binder art should be able to make such an assessment.

In order to obtain good conductivity, the concentration of carbon black in the coating must be high enough to provide a continuous conductive pathway throughout the coating. Since the conductivity of carbon black is isotropic; that is, it does not rely on the juxtaposition of the carbon along a particular plane to yield a conductive path through the coating, the threshold concentration of carbon black required to provide a continuous conductive pathway throughout the coating is generally lower than the threshold concentration required for other conductive materials, such as graphite, in which the conduction is anisotropic. Below the threshold concentration of carbon black there are only intermittent conductive pathways, formed by short chains of the amorphous carbon black aggregates, which is believed to explain the poor and/or erratic conductivity of coated abrasives articles containing low loadings of carbon black. Preferably, the carbon black is present in a concentration sufficient to provide the binder adhesive layer which includes it with a surface resistivity of less than about 2000 kilo-ohms/cm, more preferably, less than about 500 kilo-ohms/cm, and most preferably, less than about 200 kilo-ohms/cm.

The carbon black aggregates useful in the invention are formed of a multitude of smaller carbon black particles which are permanently fused together during the manufacturing process. Generally these carbon black particles are nearly spherical with diameters ranging from about 15 nm to about 90 nm. Preferably, the carbon black aggregate are composed of carbon black particles having an average particle size from 10 to 60 nm, more preferably from 10 to 40 nm. The amount of carbon black in the coating composition required to form a continuous conductive pathway and lower the resistivity of the abrasive article to the range specified above depends upon the structure of the aggregate, the surface area of the aggregate, the surface chemistry of the aggregate and the size of the carbon black particles comprising the aggregate. For equal loadings of carbon black aggregates, reducing the size of the individual carbon black particles comprising the aggregates, while maintaining the other parameters constant, results in a reduction in the surface resistivity of the abrasive article.

Preferably, the size of the carbon black aggregates is less than 300 micrometers. More preferably, the size of the carbon black aggregates is in the range of 125 to 275 micrometers. A mixture of carbon black aggregates having 2 or more sizes of carbon black aggregates (e.g., a mixture of relatively large aggregates and relatively small aggregates) may also be used. Such mixtures would tend to provide a more efficient distribution of carbon black aggregates in the adhesive binder.

The structure of carbon black aggregates refers to the size and configuration of the aggregate. High structure carbon blacks are composed of relatively highly branched aggregates while low structure carbon blacks are composed of relatively small compact aggregates. The structure of carbon black aggregates is characterized by the aggregate's void volume. High structure carbon blacks contain more void space than low structure carbon blacks because their highly branched shape prevents close packing. One common way of quantifying structure is the Dibutyl Phthalate Absorption Test. This test measures the volume of dibutyl phthalate (in ml) absorbed by 100 g of carbon black, which is a measure of the amount of fluid required to fill the voids between aggregates. The dibutyl phthalate absorption can be used as a guide to structure level because, for a given surface area, the higher the structure, the higher the dibutyl phthalate absorption will be. For equal loadings of carbon black aggregates, increasing the structure of the carbon black aggregates used, while maintaining the other parameters constant, results in a reduction in the surface resistivity of the cured adhesive binder layer containing the carbon black aggregates. Preferably the carbon black aggregates have a dibutyl phthalate absorption of from about 50 to 400 ml/100 g, more preferably, from about 100 to 400 ml/100 g.

Additionally, in the manufacturing process of all furnace type carbon blacks, chemisorbed oxygen complexes, such as carboxylic, quinonic, lactonic, and hydroxylic groups, form on the surface of the aggregates. These adsorbed molecules can be driven off by heating the carbon black aggregates to temperatures of about 950 C and are thus referred to as the volatile content. Since these adsorbed molecules act as an electrically insulating layer on the surface of the carbon black aggregates, decreasing the volatile content of the carbon black aggregates used, while maintaining the other parameters constant, results in a reduction of the surface resistivity of the adhesive binder containing the carbon black aggregates. At volatile contents greater than about 4 percent by weight the carbon black aggregates are nonconductive. Preferably the volatile content of the carbon black aggregates is less than about 3 percent by weight, more preferably, less than about 2 percent.

The reduction in the surface resistivity of the adhesive binder containing the carbon black aggregates is also a function of the surface area of the carbon black aggregates used. For equal loadings of carbon black aggregates, increasing the surface area of the carbon black aggregates, while maintaining the other parameters constant, results in a reduction in the surface resistivity of the abrasive article. Preferably the surface area of the carbon black aggregates is from about 100 to 1000 $m^2/g$, more preferably, from about 130 to 1000 $m^2/g$.

Preferably the total solid content of an uncured adhesive binder according to the present invention is in the range of 20 to 75 weight percent. More preferably the total solids content is in the range of 35 to 65 weight percent.

In another aspect, preferably the viscosity of an uncured adhesive binder according to the present invention is in the range of 25 to 2000 cps. More preferably the viscosity is in the range of 100 to 1000 cps, and most preferably in the range of 100 to 750 cps.

The present invention is further illustrated by the following nonlimiting examples wherein all parts and percentages are by weight unless otherwise specified. In these examples carbon black aggregates were mixed throughout a binder resin coating formulation by an air driven stirrer equipped with a propeller blade (commercially available from GAST Manufacturing Corp.), and the resulting mixture was coated onto a sanding belt. The coating was then cured in a forced air oven. The sanding belts were then installed on an Oakley Model D semi-automatic single belt sander (The Oakley Company; Bristol, Tenn.), and used to sand wood or woodlike products. The use of abrasive having the inventive adhesive binder layer comprising carbon black aggregate yielded a noticeable increase in the amount of dust removed by the exhaust system.

EXAMPLE 1

A silicon carbide, Y weight, cloth sanding belt, 15 cm×762 cm, was made using a filled phenolic resole make coat and grade 120 (average particle size of about 116 micrometers) silicon carbide abrasive particles. A size coat adhesive was prepared according to the following steps:

a) adding about 10.9 parts ethylene glycol monoethyl ether to about 89.1 parts water;

b) adding 503 grams of a sodium naphthalene sulfonate/formaldehyde copolymer dispersing agent (DAXAD 11G; W. R. Grace & Co.; Lexington, MA) to 6281 grams of the mixture prepared in step (a), while stirring;

c) adding the mixture for step (b) to 7725 grams of a phenolic resole (phenolic resin having a phenol to formaldehyde ratio of about 1:2 and a solids content of 76 percent), while stirring; and d) adding 493 grams of carbon black aggregates having a volatile content of 1.2 percent, a surface area of 1000 $m^2/g$, and a dibutyl phthalate absorption of 370 ml/100 g, and composed of carbon black particles having an average particle size of about 35 nm (PRINTEX XE-2; Degussa; Frankfurt, West Germany) to the mixture from step (c), while stirring; and e) stirring the mixture from step (e) until thoroughly mixed.

The size coat adhesive binder was applied to the silicon carbide coated belt described above.

After the size coat had cured, the surface resistivity of the cured size coat was measured by placing the probes of an ohmmeter (Beckman Industrial Digital Multimeter, Model 4410) onto the surface of the cured size coat 1.0 cm apart. This yielded a surface resistivity value of 21.7±6.1 kilo-ohms/cm.

EXAMPLE 2

The surface of a grade 100 (average particle size of about 15 micrometers), silicon carbide, E weight paper sanding belt having a hide glue make coat and an unfilled phenolic resole size coat, 15 cm×762 cm, was made conductive by applying a conductive supersize coating, wherein the supersize coat adhesive was prepared according to the following steps:

a) adding 18 parts of a dispersing agent (DAXAD 11G) to 61.2 parts water, while stirring;

b) adding 19.8 parts of the dispersing agent/water mixture prepared in step (a) to 601.1 parts water, while stirring;

c) adding 157.7 parts ethylene glycol monoethyl ether to the mixture from step (b), while stirring;

d) adding 40.5 parts of carbon black aggregates having a volatile content of 1.5 percent, a surface area of 254 $m^2/g$, and a dibutyl phthalate absorption of 185 ml/100 g, and composed of carbon black particles having an average particle size of 35 nm (VULCAN XC-72R; Cabot Corp.; Boston, Mass.) to the mixture from step (c), while stirring;

e) repeating steps (b) and (c) 3 times (to provide a mixture comprising 662.3 parts water, 157.7 parts ethylene glycol monoethyl ether, 18 parts dispersing agent, and 162 parts carbon black);

f) adding about 11.1 parts ethylene glycol monoethyl ether to about 88.9 parts water;

g) adding 2746 grams of the ethylene glycol monoethyl ether/water mixture from step (f) to 1941 grams of a melamine-formaldehyde resin (MF-405; BTL Specialty Resins Corp.; Warren, N.J.), while stirring;

h) adding 2147 grams of kaolin to the mixture from step (g), while stirring;

i) adding 8120 grams of the mixture from step (e) to the mixture from step (h), while stirring; and j) stirring the mixture from step (i) until thoroughly mixed.

After curing the supersize coating, the surface resistivity of the abrasive belt was measured as described in Example 1 and found to be less than 100 kilo-ohms/cm.

This belt and a similar belt having no supersize coating and having a measured surface resistivity of greater than 20,000 kilo-ohms/cm were used to sand red oak workpieces on an Oakley Model D single belt sander with a belt speed of 1670 surface meters per minute (smpm) (5500 surface feet per minute (sfpm)). When using the belt having the conductive supersize coating no electrical shocks were experienced by the operator from the steel stop used to limit the workpiece's movement, and dust accumulation on the workpiece and on the sanding machine were greatly reduced. In contrast, when using the similar belt having no conductive supersize coating the operator experienced many shocks and dust accumulation was greatly increased.

Additionally, an ammeter was connected to the steel stop used to limit the workpiece's movement and to ground in order to check for measurable current flow. Using the nonconductive belt resulted in a current flow of from 0.4 to 2.2 microamps. In contrast, the use of the abrasive belt having the conductive supersize coating produced no measurable current flow.

EXAMPLE 3

Two silicon carbide, E weight paper, sanding belts (15 cm×762 cm) were made using a phenolic resole make coat and grade P180 (average particle size of about 78 micrometers) silicon carbide abrasive particles. To one belt was applied a standard nonconductive resole size coating. To the other was applied a carbon black containing conductive coating prepared according to the following steps:

(a) adding 1 part ethylene glycol monoethyl ether to 9 parts water;

(b) adding 940 grams of the mixture from step (a) to 3790 grams of a phenolic resole (as described in Example 1), while stirring;

(c) adding 2648 grams of calcium carbonate (average size of about 16 micrometers) to the mixture from step (b), while mixing;

(d) adding 2622 grams of an aqueous dispersion comprising carbon black aggregates (prepared as described in steps (a) through (e) of Example 2) to the mixture from step (c); and (e) stirring the mixture from step (d) until thoroughly mixed.

After the size coatings had cured, both belts were evaluated on the same red oak workpiece using an Oakley Model D single belt as described in Example 1. The testing period for each belt was 45 minutes. Cut tests indicated nearly identical performance. The red oak dust concentration was measured on the operator and on the machine at a point just past the workpiece and adjacent to the exhaust by gravimetric analysis using NUCLEOPORE membrane filters having a pore size of 0.8 micrometers (commercially available from Nucleopore Corp. of Pleasanton, Calif.). For the standard nonconductive belt, the concentration of dust at the operator was 1.7 $mg/m^3$ and at the point just past the workpiece it was 170 $mg/m^3$. For the abrasive belt having the conductive size coating, the values were 1.1 $mg/m^3$ and 75.6 $mg/m^3$, respectively.

EXAMPLE 4

The surface of a grade P150 (average particle size of about 97 micrometers), aluminum oxide, F weight paper sanding belt (15 cm×762 cm) having a calcium carbonate filled phenolic resole make coat was made conductive by applying to it and curing an unfilled phenolic resole size coating prepared according to the following steps:

(a) adding 1 part ethylene glycol monoethyl ether to 1 part water;

(b) adding 160 grams of the mixture from step (a) to 5850 grams of a phenolic resin (as described in Example 1), while stirring;

(c) adding 4290 grams of an aqueous dispersion comprising carbon black aggregates (prepared as described in steps (a) through (e) of Example 1) to the mixture from step (b); and (d) stirring the mixture from step (d) until thoroughly mixed.

This formulation, when cured, was 13.5 percent by weight carbon black. The surface resistivity of the sanding belt was determined, as described in Example 1, to be less than 150 kilo-ohms/cm.

EXAMPLE 5

The surface of a grade P150, aluminum oxide, sanding belt, as described in Example 4, was overcoated with the size coating composition of Example 4 with the exception that an equal amount of graphite particles having an average particle size of 5 micrometers (commercially available from Dixon Ticonderoga Co. of Lakehurst, N.J.) was substituted for the carbon black aggregates. This formulation, when cured, yielded a surface resistivity of over 20,000 kilo-ohms/cm.

EXAMPLE 6

The surface of a grade P150, aluminum oxide, sanding belt, as described in Example 4, was made conductive by applying a filled phenolic resole size coating prepared as described in Example 3, which, when cured, was filled to 52 weight percent overall (45% calcium carbonate, 7% carbon black). This adhesive binder formulation, when cured, provided the sanding belt with a surface resistivity of less than 100 kilo-ohms/cm.

EXAMPLE 7

The surface of a grade P150, aluminum oxide, sanding belt, as described in Example 4, was overcoated with the size coating composition of Example 6 with the exception that an equal amount of graphite particles having an average particle size of 5 micrometers (commercially available from Dixon Ticonderoga Co.) was substituted for the carbon black aggregates. This formulation, when cured, yielded a surface resistivity of over 20,000 kilo-ohms/cm.

The grade P150, aluminum oxide, sanding belts prepared in Examples 4–7 were mounted on an Oakley Model D-1 single belt sander, operating at 1670 surface meters per minute (smpm) (5500 surface feet per minute (sfpm)) and under a constant 4.55 kg (10 lb.) load, and used to sand red oak workpieces for a period of 30 minutes. A 40.6 cm×59.7 cm aluminum plate was placed between the end of the workpiece and the outlet dust hood. This plate was used both to collect the wood dust that would normally fall onto the sanding table during the test period and to measure the current generated by the electrostatically charged dust. The amount of dust collected was weighed after each test period, and current measurements were made by connecting an ammeter between the plate and a ground. For each belt tested, the total mass of wood stock removed by sanding was divided by the mass of dust collected on the aluminum plate to generate a dimensionless Dust Efficiency Factor (DEF). Thus, high values of the DEF indicate that the production of dust uncollected by the exhaust system was low; that is, the abrasive belt having the conductive size coat was efficient in keeping static electricity to a minimum.

The results of these tests are shown below in Table 1 for the belts of Examples 4–7. Two representative test runs are shown for each Example.

TABLE 1

| Example No. | DEF | Current Generated (microamps) |
|---|---|---|
| 4 | a) 94.1 | .03–.05 |
| 4 | b) 87.7 | .05–.07 |
| 5 | a) 16.0 | 1.35–1.40 |
| 5 | b) 16.4 | .67–1.34 |
| 6 | a) 74.2 | .03–.04 |
| 6 | b) 85.5 | .05–.06 |
| 7 | a) 8.3 | 1.37–1.59 |
| 7 | b) 13.5 | .55–.69 |

In all cases, as can be seen from the data in Table 1, carbon black is much more efficient in reducing the amount of dust than graphite containing size coats.

EXAMPLE 8

In order to test the performance of a coated abrasive having a conductive supersize coat with a second non-conductive zinc stearate supersize coating, a grade P180 (average particle size of about 78 micrometers), aluminum oxide, F weight paper abrasive article was first fabricated using a hide glue make coat and urea-formaldehyde size coat. The abrasive article was then overcoated with a urea-formaldehyde supersize coating solution which contained 13.9 percent by weight of the carbon black aggregates used in Example 2. The surface resistivity was measured at less than 100 kilo-ohms/cm. The abrasive article was then coated with a 12.6% solution of zinc stearate in water. The coated abrasive article was then converted into belts 15.2 cm×762 cm. When tested on the Oakley sander (as described in Example 1), the amount of wood dust observed on the sanding table and on the workpiece after test completion was remarkably reduced with respect to the amount of dust observed when using a non-conductive belt.

EXAMPLE 9

The back surface of a grade P150 (average particle size of about 97 micrometers), aluminum oxide, E weight paper sanding belt (15 cm×762 cm) having a hide glue make coat and a calcium carbonate filled phenolic resole size coat was made conductive by applying thereto a backsize coat formulation which was prepared according to the following steps:

(a) adding 198.6 grams of water to 166.4 grams of urea-formaldehyde (Durite AL8405; Borden Chemical; Ontario, Canada), while stirring;

(b) adding 191.9 grams of an aqueous dispersion of carbon black aggregates having a volatile content of 1.5 percent, a surface area of 254 $m^2/g$, and a dibutyl phthalate absorption of 185 ml/100 g, and composed of carbon black particles having an average size of 30 nm (BS 10795; CDI Dispersions; Newark, N.J.) to the mixture from step (a), while stirring;

(c) adding 2.9 grams of aqueous aluminum chloride (28% solids) to the mixture from step (b), while stirring; and (d) stirring the mixture from step (c) until thoroughly mixed.

After curing the coating, the surface resistivity of the back surface was less than 50 kilo-ohms/cm.

The grade P150, aluminum oxide, sanding belt of Example 9 and a belt identical in all respects except that it did not have the conductive coating were mounted on an Oakley Model D single belt sander, operating at 1760 smpm (5500 and under a constant 4.55 kg (10 lb.) load, and used to sand red oak workpieces for a period of 21 minutes. The Dust Efficiency Factor was measured for each belt by the method described above for the belts of Examples 4–7. The belt of Example 9 having the conductive size coat had a DEF of 25.4 and the nonconductive belt had a DEF of 3.0. Additionally, the belt of Example 9 having the conductive size coat removed about 10 percent more stock and had an abrading surface that was remarkably cleaner than that of the nonconductive belt.

EXAMPLE 10

A make adhesive was prepared by thoroughly mixing the following:

6215 grams of a phenol-resorcinol-formaldehyde resin (76% solids); and 3785 grams of an aqueous carbon black dispersion (prepared as described in steps (a) through (e) of Example 2)

This make adhesive was applied to a F weight paper backing to provide an average wet add-on weight of 45 grams/square meter. Immediately afterwards, grade P150 aluminum oxide abrasive grains were projected into the make coat to provide an average add-on weight of 134 grams/square meter. The resulting composite was precured for 25 minutes at 88° C. The surface resistivity of this unsized coated abrasive was measured in the same manner as Example 1 and the value was less than 200 kilo-ohms/cm. A calcium carbonate filled resole phenolic resin size adhesive was applied over the abrasive grains to provide an average add-on wet weight of 76 grams/square meter. The size adhesive was cured and the resulting coated abrasive was converted into 15 cm×762 cm endless belts. The surface resistivity of the cured size coat was determined, as described in Example 1, to be greater than 20,000 kilo-ohms/cm. A control belt was prepared in the same manner as Example 10 except it did not contain carbon black aggregates in the make adhesive.

The Dust Efficiency Factor of the Example 10 and the control were tested in the same manner as Example 4 except the test length was reduced to 21 minutes. The results are shown below in Table 2.

TABLE 2

| Example No. | DEF |
|---|---|
| Example 10 | 40.2 |
| Control-A | 2.7 |

The data indicate the construction having a make coat comprising carbon black aggregates was much more efficient in reducing the amount of dust than a conventional construction.

EXAMPLE 11

A Y weight sateen polyester cloth was saturated with a phenolic/latex solution and then partially cured until the treated cloth was dry to the touch. Next a presize coating composition containing the carbon black aggregates was knife coated on the abrasive side of the cloth to provide an average add-on wet weight of 117 grams/square meter. The presize coating composition was prepared by thoroughly mixing:

3905 grams of AEROFENE 72155-W-55 phenolic resin (Ashland Chemical Company; Columbus, Ohio);

3065 grams of HYCAR Nitrile Latex 1571 (BF Goodrich Company; Cleveland, Ohio); and 3030 grams of a carbon black aggregate dispersion (prepared as described in steps (a) through (e) of Example 2).

The presize coating composition was partially cured until the treated cloth was dry to the touch. A backsize coating composition was then applied to the non-abrasive side of the cloth, i.e. opposite the presize. The backsize coating composition consisted of a phenolic/latex resin and was partially cured in the same manner as the saturant. Next, a conventional make adhesive, abrasive grain and the size adhesive were applied to the treated backing in a traditional manner to form the coated abrasive. The make and size adhesives were conventional calcium carbonate filled resole phenolic resins. The abrasive grain was grade 120 silicon carbide. After the size adhesive was applied, the construction was fully cured for 10 hours at 95° C.

Two controls, Control-B and Control-C, were prepared in the same manner as Example 11 but with the following exceptions. The presize coating composition used to prepare Control-B did not contain carbon black aggregates. The presize for Control-C, which contained graphite rather than carbon black aggregates, was prepared by thoroughly mixing:

4605.3 grams of phenolic resin (AEROFENE 72155-W-55);

3614.8 grams of HYCAR Nitrile Latex 1571; and 868 grams of graphite (LONZA K6; Lonza Inc.; Fair Lawn, N.J.).

The Example 11, Control-B, and Control-C abrasive articles were converted into 15 cm x 762 cm endless belts. The cut performance of these belts were evaluated as described in Example 2. The DEF as defined in Example 7 of each construction, was also determined. The data are provided below in Table 3.

TABLE 3

| Example No. | Cut, grams | Dust, grams | DEF |
|---|---|---|---|
| 11 | 393 | 4 | 98.2 |
| Control-B | 409 | 38 | 10.8 |
| Control-C | 369 | 3 | 123 |

The data show the improvement in DEF by incorporating carbon black aggregates into the presize coating.

EXAMPLE 12

Example 12 was prepared as follows. One hundred and twenty-five grams of ethylene glycol monoethyl ether was added to 500 grams of water. Carbon black aggregates (as described in Example 1) was added to the ethylene glycol monoethyl ether/water mixture, while stirring, until a thick paste resulted. The total amount of carbon black added was 52.7 grams. Five hundred and forty-seven grams of the thick paste was added to 390 grams of a phenolic resole (as described in Example 1), while stirring.

The viscosity of the resulting adhesive binder, as determined using a Brookfield model LVTDV-II viscometer (Brookfield Engineering Laboratories, Inc.; Stoughton, Mass.), using a number 2 spindle at 30 rpm, was 50 cps at a temperature of 50° C.

A control adhesive binder, Control-D, was prepared as follows. Thirty-one and one-half grams of carbon black aggregates (as described in Example 1) was added to 777 grams of a phenolic resole (as described in Example 1) while stirring. The viscosity of the Control-D adhesive, as determined with the Brookfield viscometer, using a number 3 spindle, at 6 rpm was 16,100 cps at a temperature of 55° C.

A 2.5 micrometer (0.01 inch) thick film of the Example 12 and Control-D adhesives were knife coated onto glass microscope slides. The films were cured according to the following heating schedule:

25°→66° C. (150° F.) at about 2.7° C./min 66° C. for about 0.5 hours

66°→88° C. (190° F.) at about 2.2 ° C./min 88° C. for about 0.75 hours

88°→104° C. (220° F.) at about 1.1° C./min 104° C. for about 1 hour.

The amount of carbon black present in the cured Example 12 and Control-D adhesives were 12.5 and 5.1 percent, respectively. The surface resistivity of the cured Example 12 and Control-D adhesives were determined, as described in Example 1, to be less than 50 kilo-ohms/cm and greater than 20,000 kilo-ohms/cm, respectively.

EXAMPLE 13

Example 13 describes a preferred method for preparing an adhesive binder according to the present invention. This example was prepared according to the following steps:

(a) adding 18 grams of a dispersing agent (DAXAD 11G) to 61.2 grams of water, while stirring;

(b) adding 19.8 grams of the dispersing agent/water mixture from step (a) to 601.1 grams of water, while stirring;

(c) adding 157.7 grams of ethylene glycol monoethyl ether to the mixture from step (b);

(d) adding 40.5 grams of carbon black aggregates (as described in Example 1) to the mixture from step (c);

(e) repeating steps (b) and (c) 3 times (to provide a mixture comprising 662.3 grams of water, 157.7 grams of ethylene glycol monoethyl ether, 18 grams of dispersing agent, and 162 grams of carbon black aggregates);

(f) adding the mixture for step (e) to 568 grams of a phenolic resole (as described in Example 1), while stirring; and (g) stirring the mixture from step (f) until thoroughly mixed.

The viscosity of the resulting adhesive binder was determined as described in Example 12 using a number 2 spindle. The viscosity at 30 rpm was 140 cps at a temperature of 40° C.

The adhesive binder was coated onto a glass slide and cured as described in Example 12. The surface resistivity of the cured adhesive binder, as determined by the method described in Example 1, was less than 50 kilo-ohms/cm. The amount of carbon black present in the cured adhesive binder was 12.4 percent.

Various modifications and alterations of this invention will become apparent to those skilled in the art without departing from the scope of this invention, and it should be understood that this invention is not to be unduly limited to the illustrative embodiments set forth herein.

What is claimed is:

1. An abrasive article comprising:

(a) a support member having a front surface and a back surface, said support member optionally being saturated with an adhesive binder, said support member optionally having a binder adhesive coating on said front surface, and said support member optionally having a binder adhesive coating on said back surface;

(b) abrasive granules;

(c) a first layer of binder adhesive on said support member having said abrasive granules at least partially embedded therein; and (d) at least one additional layer of binder adhesive overlying said first layer of binder adhesive;

wherein at least one of said binder adhesive layers, coatings, and saturant contains a quantity of carbon black aggregates sufficient to provide said binder adhesive containing said carbon black aggregate with a surface resistivity of less than 2000 kilo-ohms/cm.

2. The abrasive article as recited in claim 1 wherein said quantity of carbon black aggregates is sufficient to provide said binder adhesive containing said carbon black aggregates with a surface resistivity of less than 500 kilo-ohms/cm.

3. The abrasive article as recited in claim 1 wherein said quantity of carbon black aggregates is sufficient to provide said binder adhesive containing said carbon black aggregates with a surface resistivity of less than 200 kilo-ohms/cm.

4. The abrasive article as recited in claim 3 wherein said carbon black aggregates are composed of carbon black particles having an average particle size of from about 10 to 60 nm.

5. The abrasive article as recited in claim 4 wherein said carbon black aggregates are composed of carbon black particles having an average particle size of from about 10 to 40 nm.

6. The abrasive article as recited in claim 3 wherein said carbon black aggregates have a surface area of from about 100 to 1000 $m^2/g$.

7. The abrasive article as recited in claim 6 wherein said carbon black aggregates have a surface area of from about 130 to 1000 $m^2/g$.

8. The abrasive article as recited in claim 3 wherein said carbon black aggregates have a dibutyl phthalate absorption of from about 50 to 400 ml/100 g.

9. The abrasive article as recited in claim 8 wherein said carbon black aggregates have a dibutyl phthalate absorption of from about 100 to 400 ml/100 g.

10. The abrasive article as recited in claim 3 wherein said carbon black aggregates have a volatile content of less than 3 percent by weight.

11. The abrasive article as recited in claim 10 wherein said carbon black aggregates have a volatile content of less than 2 percent by weight.

12. The abrasive article as recited in claim 3 wherein said carbon black aggregates have a surface area of from about 130 to 1000 $m^2/g$, a dibutyl phthalate absorption of from about 100 to 400 ml/100 g, a volatile content of less than 2 percent by weight and are composed of carbon black particles having an average particle size of from about 10 to 40 nm.

13. The abrasive article as recited in claim 3 wherein a majority of said abrasive granules are oriented such that their longer axis is nearly perpendicular to the surface of said support member.

14. The abrasive article as recited in claim 12 wherein a majority of said abrasive granules are oriented such that their longer axis is nearly perpendicular to the surface of said support member.

15. A method for making an electrically conductive coated abrasive article comprising the steps of:

(a) providing a support member having a front surface and a back surface, optionally saturating said support member with a saturant, optionally applying a presize coating on said front surface of said support member, and optionally applying a backsize coating on said back surface of said support member;

(b) applying a first layer of binder adhesive onto said support member;

(c) at least partially embedding abrasive granules in said first layer;

(d) applying at lest one additional layer of binder adhesive overlying said first layer of binder adhesive, wherein at least one of said coatings, layers, and saturant contains a quantity of carbon black aggregates sufficient to provide a cured binder adhesive containing said carbon black aggregates having a surface resistivity of less than 2000 kilo-ohms/cm; and (e) conventionally curing said coatings, layers, and saturant.

16. The method as recited in claim 15 wherein said carbon black aggregates have a surface area of from about 130 to 1000 $m^2/g$, a dibutyl phthalate absorption of from about 100 to 400 ml/100 g, a volatile content of less than 2 percent by weight and are composed of carbon black particles having an average particle size of from about 10 to 40 nm.

17. The method as recited in claim 15 wherein said coating, layers, and saturant containing said carbon black aggregates is made by a method comprising the steps of:

blending carbon black aggregates, at least one dispersion aid, and a liquid dispersing medium to provide a dispersion comprising carbon black aggregates; and (b) blending said dispersion into an adhesive binder system.

18. The method as recited in claim 15 wherein the total solids comprising the uncured adhesive binder system comprising said dispersion is in the range of 20 to 75 weight percent.

19. The method as recited in claim 15 wherein the total solids comprising the uncured adhesive binder system comprising said dispersion is in the range of 35 to 65 weight percent.

20. The method as recited in claim 17 wherein the viscosity of the uncured binder adhesive system comprising said dispersion is in the range of 25 to 2000 cps.

21. The method as recited in claim 17 wherein the viscosity of the uncured binder adhesive system said dispersion is in the range of 100 to 1000 cps.

22. The method as recited in claim 17 wherein the viscosity of the uncured binder adhesive system comprising said dispersion is in the range of 100 to 750 cps.

23. The method as recited in claim 17 wherein the weight ratio of said carbon black aggregates to said dispersion aid is in the range of 2:1 to 30:1.

24. The method as recited in claim 17 wherein the weight ratio of said carbon black aggregates to said dispersion aid is in the range of 4:1 to 12:1.

25. The method as recited in claim 17 wherein said liquid dispersing medium is water.

* * * * *

UNITED STATES PATENT AND TRADEMARK OFFICE

CERTIFICATE OF CORRECTION

PATENT NO. : 5,108,463
DATED : April 28, 1992
INVENTOR(S) : Scott J. Buchanan

It is certified that error appears in the above-indentified patent and that said Letters Patent is hereby corrected as shown below:

Column 1, lines 11-12, after "operations" add --.--.

Column 3, line 36, "reins" should read --resins--.

Column 3, line 41, "is" should read --it--.

Column 4, line 30, "30:1 and" should read --30:1, and--.

Column 5, line 13, "aggregate" should read --aggregates--.

Column 5, line 60, "Preferably the" should read --Preferably, the--.

Column 6, line 23, "Preferably the" should read --Preferably, the--.

Column 6, line 30, "More preferably" should read --More preferably,--.

Column 15, line 10, "lest" should read --least--.

Signed and Sealed this

Twenty-ninth Day of March, 1994

Bruce Lehman

*Attest:*

BRUCE LEHMAN

*Attesting Officer*

*Commissioner of Patents and Trademarks*

US005108463B1

REEXAMINATION CERTIFICATE (2970th)

United States Patent [19]

Buchanan

[11] B1 5,108,463

[45] Certificate Issued Aug. 13, 1996

[54] CONDUCTIVE COATED ABRASIVES

[75] Inventor: Scott J. Buchanan, St. Paul, Minn.

[73] Assignee: Minnesota Mining and Manufacturing Company, St. Paul, Minn.

Reexamination Request:
No. 90/003,861, Jun. 19, 1995

Reexamination Certificate for:

| | |
|---|---|
| Patent No.: | **5,108,463** |
| Issued: | **Apr. 28, 1992** |
| Appl. No.: | **551,091** |
| Filed: | **Jul. 16, 1990** |

Certificate of Correction issued Mar. 29, 1994.

Related U.S. Application Data

[63] Continuation-in-part of Ser. No. 495,458, Mar. 16, 1990, abandoned, which is a continuation-in-part of Ser. No. 396,513, Aug. 21, 1989, abandoned.

[51] Int. Cl.[6] ..... B24D 3/34; B24B 1/00

[52] U.S. Cl. ..... 51/295; 51/293; 51/298; 51/307

[58] Field of Search ..... 51/293, 295, 298, 51/307

[56] References Cited

U.S. PATENT DOCUMENTS

| | | | |
|---|---|---|---|
| 2,050,992 | 8/1936 | Aust | 51/295 |
| 2,440,300 | 4/1948 | Rushmer et al. | 51/298 |
| 2,509,652 | 5/1950 | Rushmer et al. | 264/67 |
| 3,062,633 | 11/1962 | Coes, Jr. | 51/295 |
| 3,163,968 | 1/1973 | Nafus | 451/526 |
| 3,541,739 | 11/1970 | Byron et al. | 51/295 |
| 3,942,959 | 3/1976 | Markoo et al. | 51/295 |
| 3,992,178 | 11/1976 | Markoo et al. | 51/295 |
| 4,239,503 | 12/1980 | Harris et al. | 51/298 |
| 4,240,807 | 12/1980 | Kronzer | 51/295 |
| 4,242,106 | 12/1980 | Morelock | 51/307 |
| 4,298,356 | 11/1981 | Teschner et al. | 51/297 |
| 4,317,660 | 3/1982 | Kramis et al. | 51/295 |
| 4,441,894 | 4/1984 | Serin et al. | 51/295 |
| 4,457,766 | 7/1984 | Caul | 51/298 |
| 4,469,489 | 9/1984 | Serin et al. | 51/295 |
| 4,547,204 | 10/1985 | Caul | 7/298 |
| 4,576,612 | 3/1986 | Shukla et al. | 51/295 |
| 4,588,419 | 5/1986 | Caul et al. | 51/298 |
| 4,652,274 | 3/1987 | Boettcher et al. | 51/298 |
| 4,689,242 | 8/1987 | Pike | 427/34 |
| 4,751,138 | 6/1988 | Tumey et al. | 428/323 |
| 4,832,707 | 7/1988 | Kamohara et al. | 51/307 |
| 4,988,554 | 1/1991 | Peterson et al. | 428/142 |
| 5,061,294 | 10/1991 | Harmer et al. | 51/295 |

FOREIGN PATENT DOCUMENTS

| | | |
|---|---|---|
| 7720014 | 10/1977 | Germany . |
| 54-152197 | 11/1979 | Japan . |
| 58-171264 | 10/1983 | Japan . |
| 61-152373 | 7/1986 | Japan . |
| 61-265279 | 11/1986 | Japan . |
| 885192 | 12/1961 | United Kingdom . |
| 2018811 | 10/1979 | United Kingdom . |

OTHER PUBLICATIONS

"Carbon Black for Conductive Plastics", *Schriftenreihe Pigmente*, No. 69, pp. 1–20, Degussa AG, West Germany, Apr. 1983 (with certified translation).

"Pigment Blacks for Plastic", *Schriftenreihe Pigmente*, No. 40, pp. 1 and 28–40, Degussa AG, West Germany, Mar. 1988 (with certified translation).

*Primary Examiner*—Deborah Jones

[57] ABSTRACT

A coated abrasive article having carbon black aggregates incorporated into the construction thereof, in a concentration sufficient to reduce or eliminate the buildup of static electricity during its use.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 15–25 is confirmed.

Claim 1 is determined to be patentable as amended.

Claims 2–14, dependent on an amended claim, are determined to be patentable.

New claims 26–37 are added and determined to be patentable.

1. An abrasive article comprising:

(a) a support member having a front surface and a back surface, said support member optionally being saturated with an adhesive binder, said support member optionally having a binder adhesive coating on said front surface, and said support member optionally having a binder adhesive coating on said back surface;

(b) abrasive granules;

(c) a [first] *make* layer of binder adhesive on said support member having said abrasive granules at least partially embedded therein; and (d) at least one additional layer of binder adhesive overlying said [first] *make* layer of binder adhesive;

wherein at least one of said binder adhesive layers, coatings, and saturant contains a quantity of carbon black aggregates sufficient to provide said binder adhesive containing said carbon black aggregate with a surface resistivity of less than 2000 kilo-ohms/cm.

*26. An abrasive article comprising:*

*(a) a support member having a front surface and a back surface, said support member optionally being saturated with an adhesive binder, said support member optionally having a binder adhesive coating on said front surface, and said support member optionally having a binder adhesive coating on said back surface;*

*(b) abrasive granules;*

*(c) a first layer of binder adhesive on said support member having said abrasive granules at least partially embedded therein;*

*(i) a majority of said abrasive granules being oriented such that their longer axis is nearly perpendicular to the surface of said support member;*

*(d) at least one additional layer of binder adhesive overlying said first layer of binder adhesive;*

*wherein at least one of said binder adhesive layers, coatings, and saturant contains a quantity of carbon black aggregates sufficient to provide said binder adhesive containing said carbon black aggregate with a surface resistivity of less than 200 kilo-ohms/cm.*

*27. The abrasive article as recited in claim 26 wherein said carbon black aggregates are composed of carbon black particles having an average particle size of from about 10 to 60 nm.*

*28. The abrasive article as recited in claim 27 wherein said carbon black aggregates are composed of carbon black particles having an average particle size of from about 10 to 40 nm.*

*29. The abrasive article as recited in claim 26 wherein said carbon black aggregates have a surface area of from about 100 to 1000 $m^2/g$.*

*30. The abrasive article as recited in claim 29 wherein said carbon black aggregates have a surface area of from about 130 to 1000 $m^2/g$.*

*31. The abrasive article as recited in claim 26 wherein said carbon black aggregates have a dibutyl phthalate absorption of from about 50 to 400 ml/100 g.*

*32. The abrasive article as recited in claim 31 wherein said carbon black aggregates have a dibutyl phthalate absorption of from about 100 to 400 ml/100 g.*

*33. The abrasive article as recited in claim 26 wherein said carbon black aggregates have a volatile content of less than 3 percent by weight.*

*34. The abrasive article as recited in claim 33 wherein said carbon black aggregates have a volatile content of less than 2 percent by weight.*

*35. The abrasive article as recited in claim 26 wherein said carbon black aggregates have a surface area of from about 130 to 1000 $m^2/g$, a dibutyl phthalate absorption of from about 100 to 400 ml/100 g, a volatile content of less than 2 percent by weight and are composed of carbon black particles having an average particle size of from about 10 to 40 nm.*

*36. An abrasive article comprising:*

*(a) a support member having a front surface and a back surface, said support member optionally being saturated with an adhesive binder, said support member optionally having a binder adhesive coating on said front surface, and said support member optionally having a binder adhesive coating on said back surface;*

*(b) abrasive granules;*

*(c) a first layer of binder adhesive on said support member having said abrasive granules at least partially embedded therein;*

*(i) a majority of said abrasive granules being oriented such that their longer axis is nearly perpendicular to the surface of said support member;*

*(d) at least one additional layer of binder adhesive overlying said first layer of binder adhesive;*

*wherein at least one of said binder adhesive layers, coatings, and saturant contains a quantity of carbon black aggregates sufficient to provide said binder adhesive containing said carbon black aggregate with a surface resistivity of less than 2000 kilo-ohms/cm.*

*37. The abrasive article as recited in claim 36 wherein said carbon black aggregates have a surface area of from about 130 to 1000 $m^2/g$, a dibutyl phthalate absorption of from about 100 to 400 ml/100 g, a volatile content of less than 2 percent by weight and are composed of carbon black particles having an average particle size of from about 10 to 40 nm.*

* * * * *